United States Patent [19]

Holben

[11] Patent Number: 4,479,520

[45] Date of Patent: Oct. 30, 1984

[54] BALANCED PRESSURE COUPLING

[75] Inventor: Clair D. Holben, Denver, Colo.

[73] Assignee: The Coca-Cola Company, Atlanta, Ga.

[21] Appl. No.: 539,415

[22] Filed: Oct. 6, 1983

Related U.S. Application Data

[63] Continuation of Ser. No. 323,309, Nov. 20, 1981, abandoned.

[51] Int. Cl.[3] ..... B65B 3/04

[52] U.S. Cl. ..... 141/1; 141/4; 141/353; 141/392; 222/160; 222/396; 251/DIG. 1; 285/104; 285/189

[58] Field of Search ..... 285/104, 105, 189, 190; 141/1-12, 37-66, 285-310, 346-362, 392; 251/DIG. 1; 222/3-6, 396, 160, 162

[56] References Cited

U.S. PATENT DOCUMENTS 3,771,762 11/1973 Mayernik et al. ..... 251/148

4,357,284 11/1982 Sedam ..... 261/121 R

FOREIGN PATENT DOCUMENTS 1294881 11/1972 United Kingdom .

*Primary Examiner*—Houston S. Bell, Jr.

[57] ABSTRACT

A coupler adaptor is provided for use in operative association with a container and a valve. The container houses relatively high pressurized carbon dioxide gas for use in carbonating a beverage. The valve is actuated in order to release the gas to an interface passage formed in the coupler adaptor. The coupler adaptor also has a pair of grooves formed on opposite sides of the interface passage for receiving O-rings. The coupler adaptor is also in operative association with a pressure regulator. The pressurized gas enters the pressure regulator from the coupler adaptor interface passage. In one embodiment, the coupler adaptor remains operatively joined to the pressure regulator without retaining structure due to the balanced gas pressure which results because of the O-rings positioned adjacent the coupler adaptor interface passage.

12 Claims, 7 Drawing Figures

BALANCED PRESSURE COUPLING

This is a continuation of application Ser. No. 323,309 filed Nov. 20, 1981 now abandoned.

FIELD OF THE INVENTION

The present invention relates to devices which are coupled to containers having pressurized fluids housed therein and, in particular, to a coupling apparatus which does not require retaining means for holding the coupling apparatus to a pressurized fluid-containing cylinder when the pressurized fluid is released therefrom to the coupling apparatus.

BACKGROUND ART

Various coupling devices are known for connection to a container housing fluid under pressure and in which the container or the coupling device includes a valve for releasing the fluid from the container into the coupling device. Each of these known coupling devices requires some retaining structure to maintain the coupling device and the container in secure operative association with each other when the pressurized fluid escapes the container and flows into the coupling device. As can be readily appreciated, the force of a highly pressurized gas exiting the container into a coupling device joined to the container can easily separate the container and coupling device. Typically, such retaining structure used in prior art coupling devices includes threads for interconnecting with threads formed in the container. Alternatively, the retaining structure includes a clamp or strap for maintaining a secure connection between a coupling device and the container or a valve.

It has been found desirable to eliminate the use of such retaining structures in order to simplify the connection between a container or valve and the coupling device and to minimize the amount of space taken by the container, valve, and coupling device. As a result of simplifying these connections, the assembly and disassembly of the container is facilitated and enhanced. More specifically, it has been found advantageous to invert a pressurized fluid containing cylinder and provide a coupler adaptor for passing pressurized fluid into a pressure regulator without the use of retaining structure for holding the pressure regulator and cylinder together. In this regard the present invention includes a coupler adaptor which remains in operative association with the cylinder and pressure regulator when relatively high pressurized fluid is released from the container through a valve to the coupler adaptor and to the pressure regulator. The coupler adaptor remains joined to the container and pressure regulator because of a pressure balancing arrangement.

PRIOR ART STATEMENT

The following known prior art patent references are submitted under the provisions of 37 C.F.R. 1.97(b).

U.S. Pat. No. 3,319,829 to Sentry discloses a pressure regulator which is connected to a housing by means of threads. The housing includes an opening for receiving a cylinder which houses gas under relatively high pressure. The gas is released into the pressure regulator in a direction parallel to its escape from the cylinder. An O-ring seal is provided adjacent the connection of the pressure regulator to the housing in order to prevent leakage of the gas.

U.S. Pat. No. 2,524,052 to Grant, Jr. describes a valve assembly which is held by threads to a container. A valve operating member is joined to and movable relative to the valve assembly by means of a threaded coupling nut. An O-ring seal prevents leakage of gas between the coupling nut and the valve operating member.

U.S. Pat. No. 1,910,283 provides a valve arrangement including a casing threadedly connected to a cylinder housing pressurized fluid. A thrust screw is used to permit the opening of a check valve and the escape of pressurized fluid.

SUMMARY OF THE INVENTION

A coupling assembly having a coupler adaptor is provided for connection to a container assembly. The container assembly houses pressurized fluid. A check valve is provided to retain the pressurized fluid.

In one embodiment of the invention, the coupler adaptor includes a generally cylindrical body having the check valve extending therethrough. The cylindrical body is integrally joined to a housing which is threadably connected to the container assembly for housing the pressurized fluid. The cylindrical body includes two grooves. An O-ring is seated in each groove and an interface passage is formed between the two O-rings. The pressurized fluid moves past the check valve and through the interface passage to a pressure regulator.

In another embodiment of the present invention, the container assembly includes a valve body having a recess into which the coupler adaptor is slidably fitted. The valve body houses the check valve. The coupler adaptor is threadably attached to a pressure regulator or other coupling device for receiving the pressurized fluid from the container. The pressurized fluid is released from the container assembly when the check valve is engaged. The pressurized fluid escapes from the container assembly into the pressure regulator through the interface passage formed in the coupler adaptor. A pair of O-rings is also included, as in the first embodiment, adjacent the interface passage. In both embodiments, the O-rings on both sides of the interface passage prevent leakage of the pressurized fluid when it is released from the container assembly and, most significantly, provide a substantial pressure balance so that the coupling device and container assembly remain in operative association during the release of the pressurized fluid.

The present invention is particularly useful in a pressurization system, such as a carbonation system, wherein a container houses carbon dioxide under high pressure. The carbon dioxide gas in the container is permitted to controllably escape through the check valve and the coupler adaptor into a pressure regulator. The pressure regulator regulates the pressure of the gas which leaves an outlet port formed in the pressure regulator. Typically, the pressure regulated gas is used to pressurize a liquid, such as a soft drink.

In view of the foregoing description, it is readily discerned that an efficient, yet simple, coupler adaptor is provided which is quickly plugged into or slidably fitted to a pressure regulator in one embodiment or a valve body in another embodiment for connection to a container. As a result, connection and removal of the container and coupler adaptor from the pressure regulator or the connection and removal of the container from the coupler adaptor and pressure regulator is quickly and easily accomplished even when the container contents are highly pressurized. Importantly, the coupler adaptor remains coupled to or in operative association with the pressure regulator or valve body without retaining structure for securing them together, even though escaping gas from the container provides a considerable force at the interface of the coupler adaptor and the pressure regulator or valve body. Coupler parts are thereby minimized and the space required for the container, coupler adaptor, and pressure regulator is reduced.

Additional advantages of the present invention will become readily apparent from the following description when taken in conjunction with the accompanying drawings.

DETAILED DESCRIPTION OF THE PREFERRED EMBODIMENTS

Figure 1:
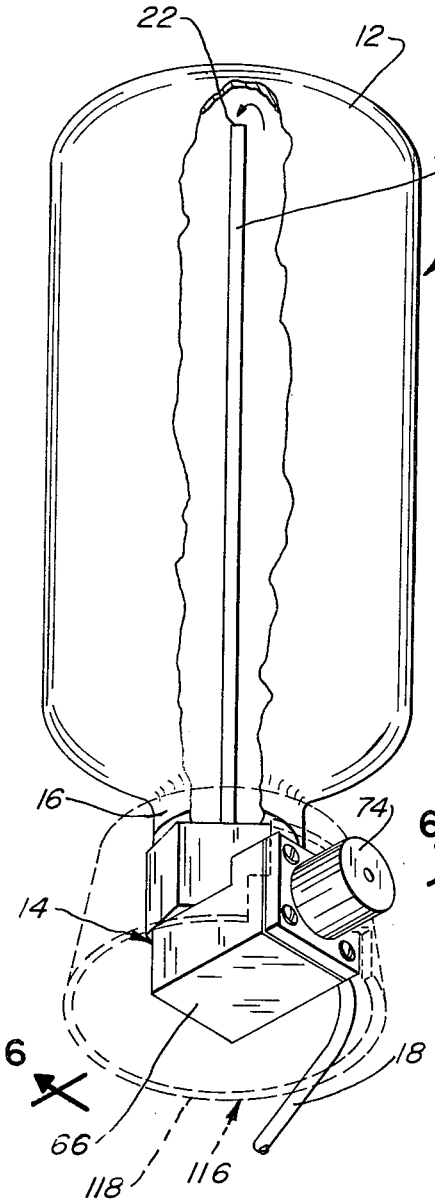
FIG. 1 is a perspective view showing the present invention with an inverted cylinder.

In accordance with the present invention, a container assembly 10 including a cylinder 12 is depicted in FIG. 1 having a coupling assembly 14 attached to the cylinder 12 at its neck 16. The cylinder 12 is typically used to contain carbon dioxide under high pressure such that a portion of the contents of the cylinder 12 is liquid carbon dioxide while the remaining portions of the contents of the cylinder 12 are gaseous carbon dioxide. The gaseous carbon dioxide is, preferably, used to carbonate beverages, such as soft drinks. Accordingly, the present invention is primarily adapted for connection to another container which houses the beverage to be carbonated. When desired, the gaseous carbon dioxide is permitted to escape the cylinder 12 and coupling assembly 14 through the outlet tube 18 into the container which houses the beverage to be pressurized or carbonated.

The coupling assembly 14 includes a coupler adaptor. In a first embodiment, the coupler adaptor is threadedly connected to the cylinder 12. In the second embodiment, the coupler adaptor is threadedly connected to a coupling body such as a pressure regulator. The coupling body or pressure regulator is also an element or part of the coupling assembly 14. The present invention is particularly characterized in that, in the first embodiment, the coupler adaptor remains in operative association with the pressure regulator when pressurized gas is permitted to escape from the cylinder 12. Similarly, in the second embodiment, the coupler adaptor remains in operative association with the container assembly 10 and cylinder 12 when pressurized gas is permitted to escape from the cylinder 12. This operative association in both embodiments does not necessitate the use of retaining structure, such as clamps, yokes, threaded attachments, and the like, unlike previously devised coupling structures wherein such retaining mechanisms were required.

Figure 2:
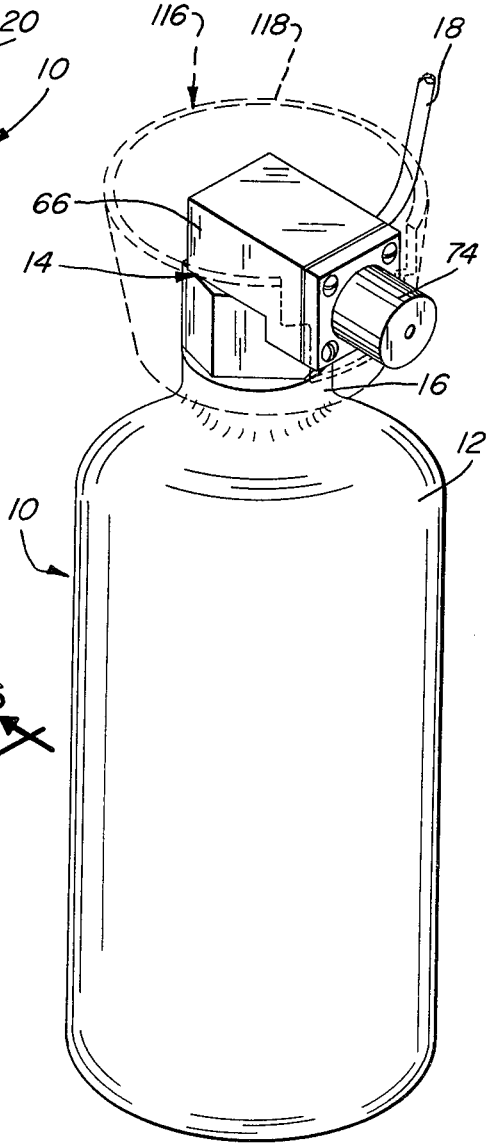
FIG. 2 is a perspective view of the present invention with the container in an upright position.

The present invention is also characterized, in its preferred configuration, by the inverted or upside down positioning of the cylinder 12, as illustrated in FIGS. 1, 3, 4, 5 and 6. However, it is understood, as illustrated in FIGS. 2 and 7, that the present invention also properly functions when the cylinder 12 is positioned right side up. That is to say, the container assembly 10 and the coupling assembly 14 remain operatively connected without the use of retaining structure when the cylinder 12 is positioned upright and gas escapes from the cylinder 12 into the coupling assembly 14.

In this regard, the notable functional difference between the use of an inverted cylinder and an upright cylinder is that, in the inverted cylinder embodiment, the weight of the cylinder and the carbon dioxide contained therein act to overcome the force of the pressurized gas in the cylinder acting on a check valve stem for releasing the pressurized gas from the cylinder. This force tends to separate the container assembly and coupler assembly. With respect to the inverted cylinder embodiment, the coupler assembly is normally fastened to and supported by a horizontal support surface while the inverted cylinder is vertically positioned above the coupler assembly while joined thereto. Consequently, the force resulting from the pressurized gas against the check valve stem, tending to separate the coupler assembly from the container assembly, is fully or at least partially overcome by the downward acting force of the weighted cylinder.

With respect to the upright cylinder embodiment in which the coupler assembly is again fastened to a horizontally extending supporting surface, the force resulting from the pressurized gas against the check valve stem tends to separate the cylinder from the coupler assembly. However, since the magnitude of the force against the check valve stem depends upon the magnitude of the pressure of the gas contained in the cylinder, this force is normally overcome by friction forces which resist the normal fluid force present in the cylinder. Additionally, the force against the check valve stem in an upright cylinder embodiment is minimized considerably through the use of a relatively small lateral or cross-sectional area. Also, this force can be negated by using a valve stem which is secured against movement in a direction towards the coupler assembly so that the force of the pressurized gas does not act to move the check valve.

Although not shown in FIGS. 1 and 2, it is understood that standard support mechanisms are usually provided to rigidly maintain the combination container assembly 10 and coupler assembly 14 in either the upright or inverted configuration. Conventional supporting assemblies can be connected to either the container assembly 10 or the coupler assembly 14 in order to prevent the overturning or tipping of the container assembly 10 and coupler assembly 14 from their substantially vertical positions. Nevertheless, it is once again emphasized that such support structure is not used to interconnect the coupler adaptor and pressure regulator with respect to the aforementioned first embodiment or, alternatively, the coupler adaptor and container assembly with respect to the aforementioned second embodiment. It is also desirable, in selecting workable support structure, that ready access to the cylinder 12 be provided so that it can be easily replaced whenever the carbon dioxide contained therein has been expended.

The detailed features of the present invention are shown in the two different structural arrangements identified here as the first and second embodiments. Although FIG. 6 depicts details of the invention with an inverted cylinder 12, while FIG. 7 illustrates details of the invention with an upright cylinder 12, it is readily appreciated that both embodiments of FIGS. 6 and 7 can be used with either an inverted or upright cylinder 12.

With reference now to the first embodiment in which the coupler adaptor is threadably connected to the container assembly 10, FIG. 1 shows that the container assembly 10 also includes a gas escape tube 20 which extends longitudinally through the cylinder 12. The gas escape tube 20 includes an inlet 22 located above the liquid carbon dioxide contained in the cylinder 12 to provide an exit for only the gaseous carbon dioxide and not the liquid carbon dioxide. Whenever the cylinder 12 is used in the inverted configuration, the escape tube 20 is utilized. Conversely, no gas escape tube 20 is included when the cylinder 12 is positioned in an upright state, as illustrated in FIG. 2, since the gaseous carbon dioxide is in the upper portions of the cylinder 12 immediately adjacent the coupling assembly 14 for release from the cylinder 12.

Figure 3:
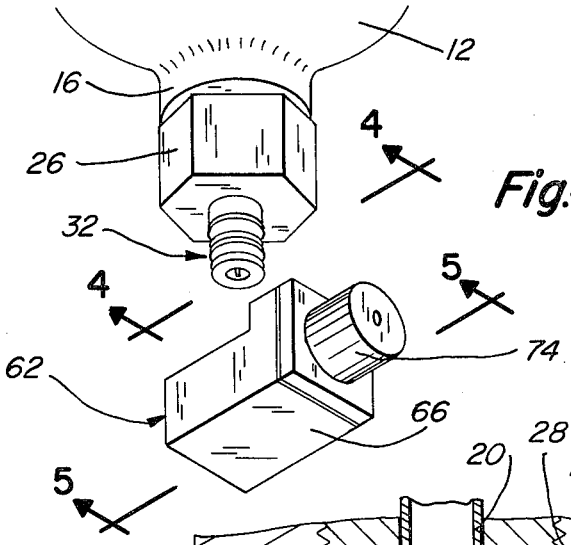
FIG. 3 is a perspective view of the inverted cylinder showing the pressure regulator separated from the coupler adaptor.
Figure 4:
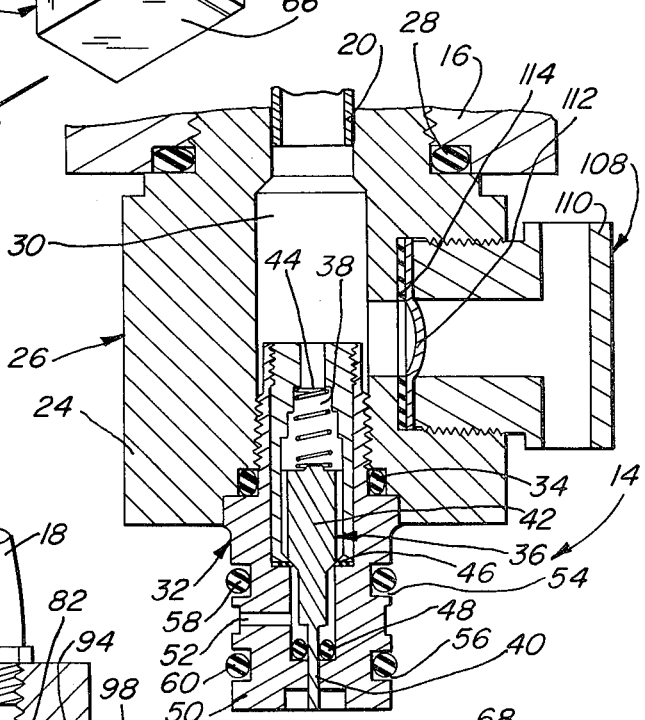
FIG. 4 is a fragmentary, enlarged, longitudinal section, taken along line 4—4 of FIG. 3, showing details of the coupler adaptor.
Figure 5:
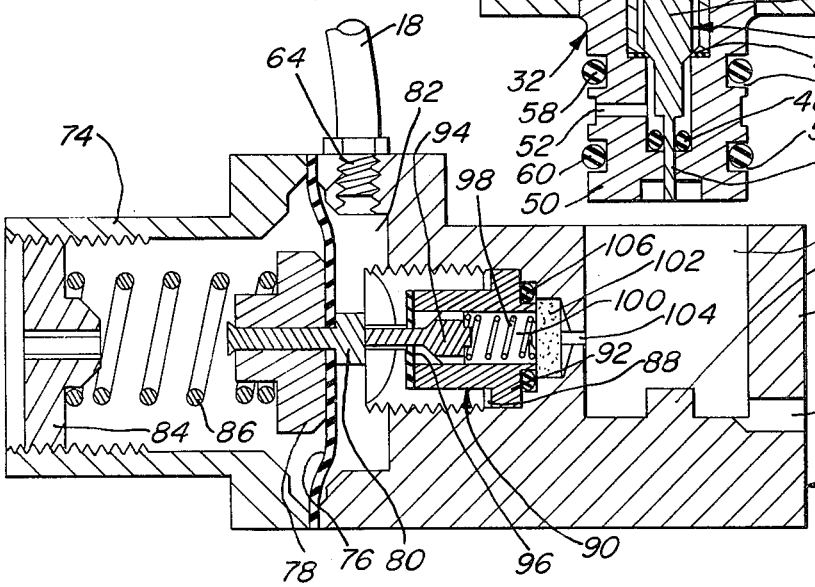
FIG. 5 is an enlarged, longitudinal section, taken along line 5—5 of FIG. 3, showing details of the pressure regulator.
Figure 6:
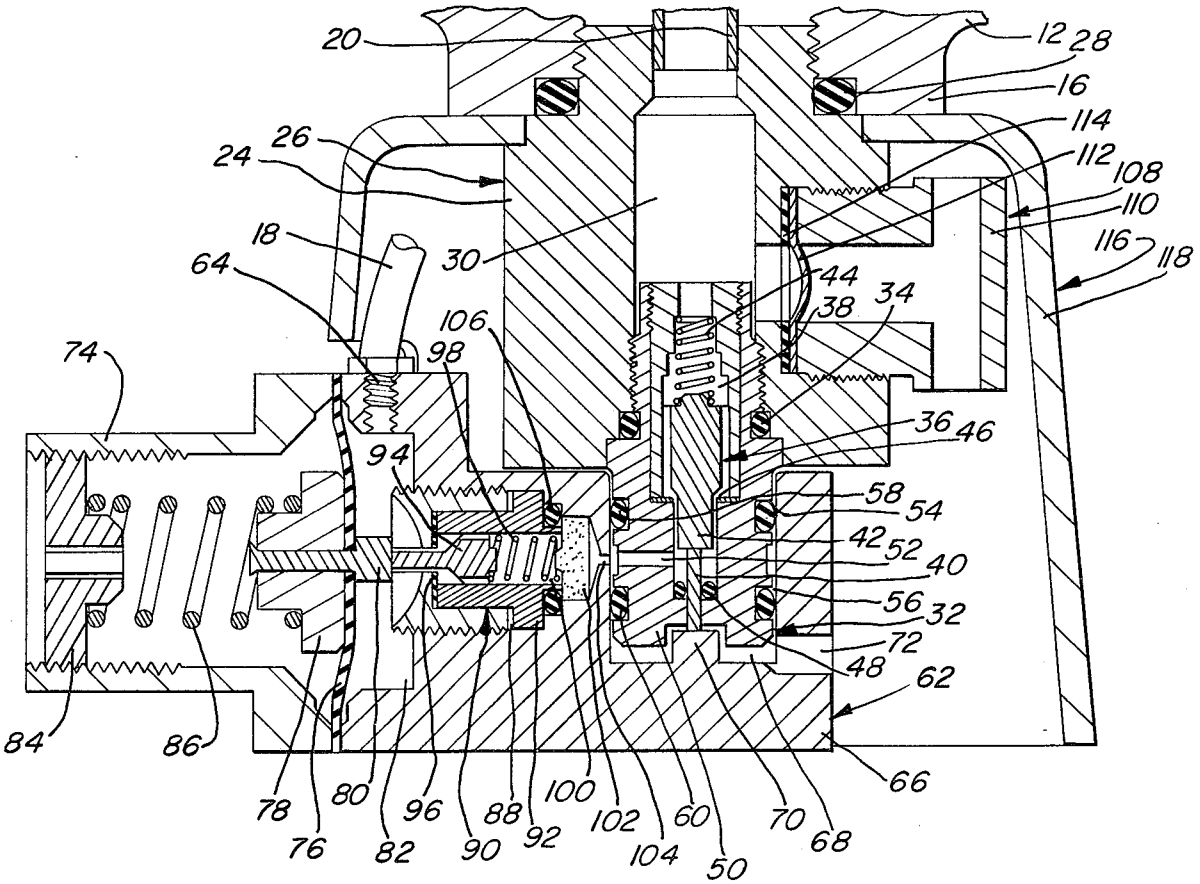
FIG. 6 is an enlarged, fragmentary, longitudinal section, taken along line 6—6 of FIG. 1, showing details of a first embodiment in which the coupler adaptor is fixedly connected to the container.
Figure 7:
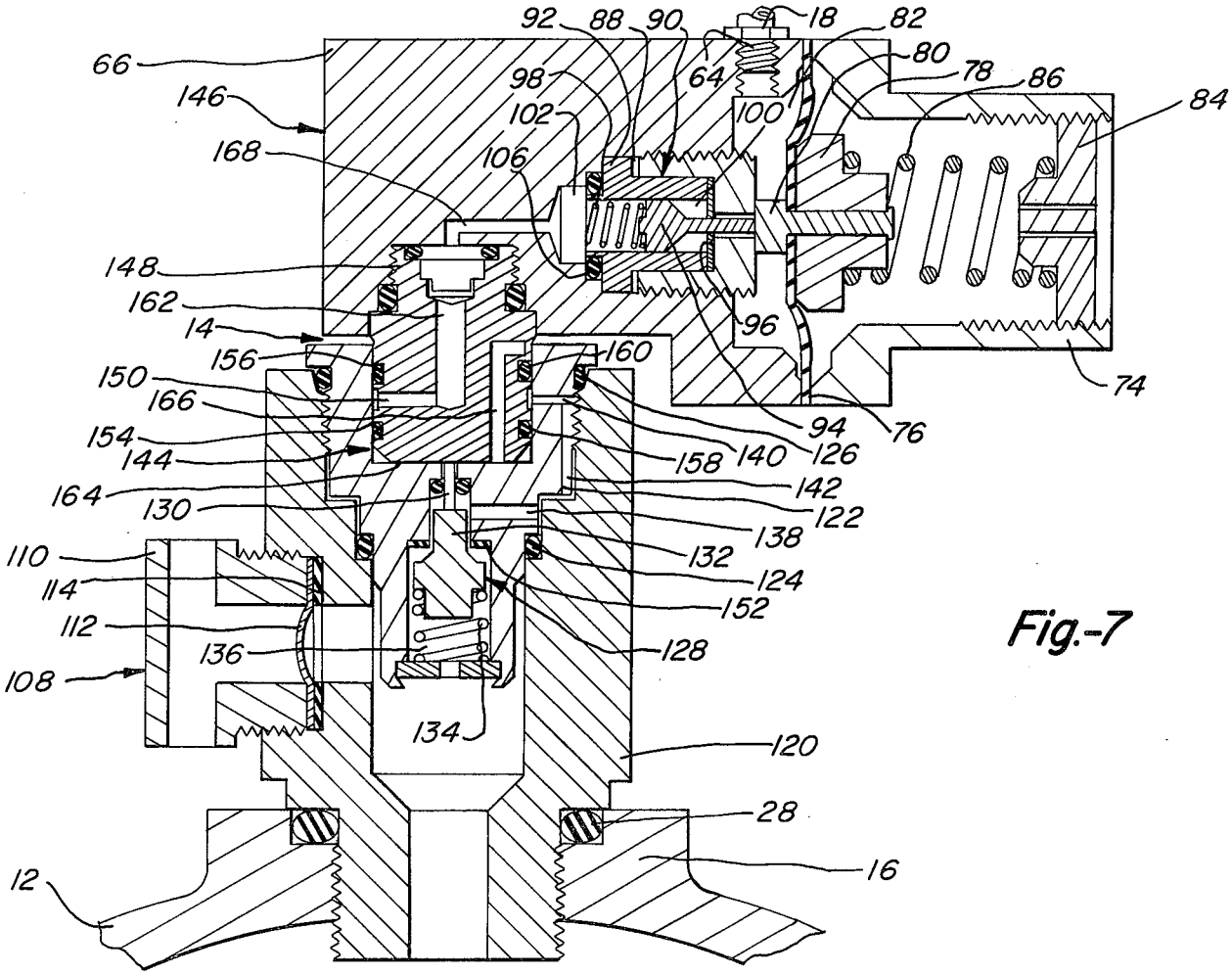
FIG. 7 is an enlarged, fragmentary, longitudinal section showing details of a second embodiment in which the coupler adaptor is fixedly connected to the pressure regulator.

Referring to FIG. 6, as well as FIGS. 3, 4 and 5, the gas escape tube 20 is integrally joined to a housing 24 of the valve assembly 26. The housing 24 is threaded for secure attachment to the neck 16 of the cylinder 12. An O-ring seal member 28 is positioned adjcent the top surface of the neck 16 to prevent leakage of the pressurized gas from the cylinder 12 through the threaded junction of the housing 26 and cylinder neck 16.

A bore 30 is formed through the center of the housing 26 for communication with the previously discussed coupler adaptor 32. The coupler adaptor 32 is fixedly joined to the housing 24 by means of interconnecting threads while an O-ring seal member 34 prevents leakage of gas through this threaded connection.

In the embodiment of FIGS. 3, 4, 5 and 6 the check valve 36 of the valve assembly 26 is operatively positioned within a coupler passageway 38 of the coupler adaptor 32. The check valve 36 includes the check valve stem 40, previously discussed in connection with the forces acting thereon, a valve plunger 42, and a valve spring 44. The valve stem 40 is integrally joined to the valve plunger 42 while the valve spring 44 is in operative engagement with the valve plunger 42. When the check valve 36 is closed, as seen in FIG. 4, the valve seat 46 acts to prevent the escape of gas from the cylinder 12. An O-ring seal 48 is located in the coupler passageway 38 around portions of the valve stem 40 to prevent escape of gas from the coupler adaptor 32 along the outer wall of the valve stem 40 whenever the check valve 36 is in its opened position.

The coupler adaptor 32 includes a generally cylindrical body 50 and an interface passage 52 which is formed perpendicular, or substantially perpendicular, to the coupler passageway 38 for providing a transverse flow of pressurized gas. A first circular groove 54 is formed in the coupler adaptor 32 at a first side of the interface passage 52 or located vertically above the interface passage 52 when the cylinder 12 is inverted. A second circular groove 56 is formed in the coupler adaptor 32 at a second side of the interface passage 52 or located vertically below the interface passage 52 when the cylinder 12 is inverted. A first O-ring seal member 58 is seated in the first groove 54 while a second O-ring seal member 60 is seated in the second groove 56.

The first and second O-ring seal members 58, 60 provide two functions critical to the proper operation of the present invention. In particular, whenever a coupling device of the coupling assembly 14 is joined to or is in operative association with the coupler adaptor 32 and engages the check valve 36 for releasing the pressurized gas from the cylinder 12, the first and second O-ring seal members 58, 60 function to balance the pressure present at the interface or area along which the pressurized gas escapes the coupler adaptor 32. As a result, the joined coupling device remains attached to the coupler adaptor 32. The balanced pressure results because the force of the escaping gas against the first O-ring seal member 58, acting to separate the coupler adaptor 32 and the coupling device, is balanced or offset by an equal force applied by the escaping gas in the opposite direction against the second O-ring seal member 60. In addition to the providing of balanced pressure along the exit interface of the coupler adaptor 32, the two O-ring seal members 58, 60 also function to prevent leakage of the gas so that the gas released from the cylinder 12 will properly pass to the operatively connected coupling device. The O-ring seal members 58, 60 also provide friction force to help keep the coupler adaptor 32 joined with a mating recess, as will now be discussed.

To provide a safety vent for pressurized fluid contained in the cylinder 12, a burst disc assembly 108 is connected to the housing 24. The burst disc assembly 108 includes a vent plug 110, a rupture disc 112 and a seal 114. The vent plug 110 is threadably fastened to the housing 24 in a recess formed in the housing 24. The seal 114 prevents leakage of the pressurized gas around the rupture disc 112 or through the threaded joint. The rupture disc 112 will rupture and permit the escape of the gas if an excessively high pressure is present within the cylinder 12. This is a required safety device and is desirable to prevent over-pressurization of the cylinder 12.

In the preferred embodiment of the present invention, the coupling device referred to above is a pressure regulator assembly 62. Basically, the pressure regulator assembly 62 regulates or controls the pressure of the gas received from the cylinder 12 through the coupler adaptor 32. The pressure regulator assembly 62 includes an outlet port 64 formed in a regulator body 66. The outlet port 64 is connected to the outlet tube 18. The outlet tube 18 carries the pressure regulated carbon dioxide gas to the container which houses the liquid. As best seen in FIG. 5, the regulator body 66 also has a recess 68 formed therein. A cylindrical valve lifting pin 70 is integral with the regulator body 66 and extends into the recess 68. A vent passage 72 is also formed in the regulator body 66. The coupler adaptor 32 is slidably fitted or plugged into the recess 68 in order to couple the coupler adaptor 32 to the pressure regulator assembly 62. The force necessary to plug the coupler adaptor 32 into the recess 68 must be of a magnitude to overcome the pressurized gas force acting on the check valve 36. This force can readily and manually be overcome by simply inserting the coupler adaptor 32 into the recess 68 and then pressing downwardly (in those instances in which the cylinder 12 is in its inverted position). The vent passage 72 permits the escape of air from between the surface of the coupler adaptor 32 and the recess 68 when the coupler adaptor 32 is inserted into the recess 68.

The pressure regulator assembly 62 further includes a regulator spring housing 74. A diaphragm 76 is located at the interface of the regulator spring housing 74 and the regulator body 66. A diaphragm back up plate 78 engages one side of the diaphragm 76 while a diaphragm rivet 80 contacts the other or pressure side of the diaphragm 76. The head of diaphragm rivet 80 is positioned within a valve chamber 82 of the regulator body 66. A forward plate 84 is threadably fastened to an end of the regulator spring housing 74 and a regulator spring 86 is operatively positioned between the diaphragm back up plate 78 and the forward plate 84.

Positioned within a cavity 88 formed in the regulator body 66 is a valve mechanism 90 which includes a bushing 92, a valve arm 94, a valve seat 96 and a helical spring 98. The valve arm 94 moves laterally in a valve passageway 100 formed in the bushing 92. The valve arm 94 is in operative engagement with the helical spring 98 at one end of the helical spring 98. The opposite end of the helical spring 98 is joined to a rigid filter disc 102 at the opposite end of the valve passageway 100. The filter disc 102 is typically made of a porous material such as sintered bronze and which is fitted into a recess formed in the end of the bushing 92. The opposite side of the filter disc 102 communicates with a regulator passage 104. The regulator passage 104, in turn, communicates with the interface passage 52. An O-ring seal 106 is positioned adjacent the bushing 92 and filter disc 102 to prevent the leakage of gas through the outer wall of the bushing 92.

Finally, a safety shroud 116 is fixedly attached between the outer surface of the neck 16 and the housing 24. The safety shroud 116 is generally bowl-shaped, as seen in FIG. 1, having a wall 118 which surrounds the coupler assembly 14 and valve assembly 26. The safety shroud 116 is preferably made of a material having a melting point at a desired temperature. If the safety shroud 116 shows signs of excess temperature, it is an indication that the temperature of the environment about the safety shroud 116 and cylinder 12 has been at an undesirable level. Thus, the distortion of the safety shroud 116 is a warning that the temperature of the cylinder 12 may have been high enough to have annealed and weakened the metal cylinder 12 to produce an unsafe operating condition. Additionally, the safety shroud 116 acts to protect the coupling assembly 14 and valve assembly 26 should the container assembly 10 and coupler adaptor 32 be inadvertently dropped during transport or during the interconnection of the coupler adaptor 32 and pressure regulator assembly 62.

In operation of the embodiment of FIGS. 1, 3, 4, 5, and 6, the housing 24 is threadably joined to the cylinder 12 and the coupler adaptor 32 is also threadably joined to the housing 24. The cylinder 12 then receives carbon dioxide under pressure through the coupler adaptor 32. When it is desired to use the gaseous carbon dioxide for carbonation purposes, for example, the cylinder 12 is inverted and the pressure regulator assembly 62 is joined to the coupler adaptor 32 by inserting or slidably fitting or plugging the coupler adaptor 32 into the recess 68 formed in the pressure regulator assembly 62. In so doing, the valve stem 40 contacts the cylindrical valve lifting pin 70 which extends into the recess 68. The force exerted by the valve lifting pin 70 against the valve stem 40 moves the valve plunger 42 away from the valve seat 46 against the force of the valve spring 44 and the pressure force acting on the check valve 42. As a result, the pressurized carbon dioxide gas is able to pass from the valve passageway 38 through the opening created at the valve seat 46 into the interface passage 52. The gas is unable to escape around the valve stem 40 because of the O-ring seal 48.

As previously discussed, balanced forces are provided at the juncture of the coupler adaptor 32 and the pressure regulator assembly 62 by means of and the location of the first and second O-ring seal members 58, 60. The gas escaping the interface passage 52 and entering the pressure regulator assembly 62 exerts equal and opposite forces against the first and second O-ring seal members 58, 60. That is, the force tending to separate the pressure regulator assembly 62 from the coupler adaptor 32 in an upward direction is balanced by the force tending to separate the pressure regulator assembly 62 from the coupler adaptor 32 in a downward direction. As a consequence, the pressurized gas exiting the interface passage 52 and entering the regulator passage 104 does not tend to separate the coupler adaptor 32 from the pressure regulator assembly 62.

Upon entering the regulator passage 104, the gas moves through the filter disc 102 into the valve passageway 100. The gas passes by the valve seat 96 into the valve chamber 82 where it exerts pressure against the side of the diaphragm 76 and escapes the pressure regulator assembly 62 through the outlet port 64. The pressure of the gas entering the pressure regulator assembly 62 is controlled by the operation of the valve mechanism 90 and the diaphragm 76. The force of the gas against the diaphragm 76 causes the diaphragm 76 to move towards the left (as viewed with respect to FIG. 3) against the force of the regulator spring 86. At a predetermined gas pressure in the valve chamber 82 acting against the diaphragm 76, the diaphragm 76, as well as the diaphragm rivet 80, move laterally to the left a sufficient distance such that the valve arm 94 contacts the valve seat 96 to thereby cut off the flow of the gas from the valve passageway 100. When the pressure is reduced below the predetermined pressure, the force of the regulator spring 86 moves the diaphragm 76 laterally towards the right, as viewed with respect to FIG. 6, to permit the flow of gas past the valve seat 92 and into the valve chamber 82 so that it can pass through the outlet port 64 and then to the container which houses the beverage to be pressurized or carbonated.

Referring now to the embodiment illustrated in FIG. 7, a connector body 120 is threadably fastened to the neck 16 of the cylinder 12, while the O-ring seal member 28 is positioned at the interface of the neck 16 and the connector body 120 to prevent the escape of gas through this threaded joint. A valve housing 122 is threadably fastened to the connector body 120 in a recess formed therein. A first O-ring seal 124 is positioned at one end of the threaded connection between the connector body 120 and the valve housing 122 and a second O-ring seal 126 is positioned at the opposite end of the threaded connection between the connector body 120 and the valve housing 122 to prevent escape of the gas through the ends of this threaded joint.

A check valve 128 is provided in a recess formed in the valve housing 122. The check valve 128, like the check valve 36, includes a valve stem 130, a valve plunger 132 and a valve spring 134. A valve passageway 136 receives pressurized gas from the cylinder 12 and carries it to a first transverse passage 138 when the check valve 128 is in its open position. A second transverse passage 140 is also formed in the valve housing 122 and communicates with the first transverse passage 138 through the slot 142.

In this embodiment, a coupler adaptor 144 is fixedly joined to a coupling device or, in the preferred embodiment, a pressure regulator assembly 146, unlike the embodiment illustrated in FIGS. 3, 4, and 6 in which the coupler adaptor 32 is threadably attached to the housing 24 of the valve assembly 26. Like the coupler adaptor 32, the coupler adaptor 144 includes a generally cylindrical body 148 and a transversely formed interface passage 150 for receiving the pressurized carbon dioxide gas whenever the valve plunger 132 is displaced away from a valve seat 152. Correspondingly also, the coupler adaptor 144 includes the first and second grooves 154, 156, respectively, into which first O-ring seal member 158 and second O-ring seal member 160 are, respectively, seated. The first and second O-ring seal members 158, 160 provide balanced fluid forces adjacent the coupler adaptor 144 and valve housing 122 interface when the carbon dioxide gas exits the valve housing 122 and enters the coupler adaptor 144. As a result, the coupler adaptor 144 and valve housing 122 remain in operative association when the check valve 128 is engaged and the carbon dioxide gas escapes the cylinder 12 past the valve plunger 132 of the check valve 128. The coupler adaptor 144 further includes a coupler passageway 162, which is in communication with the interface passage 150. The carbon dioxide gas, therefore, exits the interface passage 150 and enters the coupler passageway 162. From the coupler passageway 162, the gas flows to the pressure regulator assembly 146.

In joining the coupler adaptor 144 to the valve housing 122, the coupler adaptor 144 is inserted or slidably fitted into a recess formed in the valve housing 122 so that the top surface 164 of the coupler adaptor 144 engages the valve stem 130 of the check valve 128 in order to permit the flow of the gas into the first transverse passage 138. A vent passage 166 formed in the coupler adaptor 144 is provided to permit the escape of air between the interface of the top surface 164 of the coupler adaptor 144 and the valve housing 122 when the coupler adaptor 144 is inserted into the valve housing recess.

Like the embodiment of FIG. 6, the gas passes from the coupler passageway 162 to a regulator passage 168 formed in the pressure regulator assembly 146. The remaining elements of the pressure regulator assembly 146 are identical in structure and function to the previously described pressure regulator assembly elements so that the previous description with respect to the pressure regulator assembly 62 also applies to the pressure regulator assembly 146.

In view of the foregoing description, numerous advantages of the present invention are readily discerned. A coupler adaptor is provided for use with a valve to permit the release of a pressurized gas from a cylinder without the necessity of any additional retaining structure. The pressurized gas is released through the valve and the forces tending to separate the coupler adaptor from a body joined thereto are balanced. In this regard, the coupler adaptor is easily plugged into a recess formed in a valve housing or a pressure regulator assembly in order to open the valve and release the gas. The present invention is particularly advantageous in a beverage dispensing system in which it is desirable to quickly and efficiently replace a carbon dioxide-containing cylinder when the carbon dioxide has been expended from the cylinder. Additionally, it is equally important that the present invention provides an effective carbonation system with minimal parts in order to reduce the complexity of the system as well as to minimize the space needed for an operable carbonation system.

Although the present invention has been described with reference to a limited number of embodiments, it is readily appreciated that variations and modifications can be effective within the spirit and scope of this invention.

What is claimed is:

1. Apparatus comprising a system wherein a gas pressure regulator is connected to a source of compressed gas under relatively high pressure to provide gas for an end use at a reduced pressure from that in said source comrising:

a source of compressed gas under relatively high pressure having means attached thereto through which pressurized gas is discharged;

means operatively associated with said means through which pressurized gas is discharged for providing a first passageway for pressurized gas discharged from said means through which pressurized gas is discharged;

a gas pressure regulator having means for receiving said pressurized gas and for discharging said pressurized gas at reduced pressures;

means associated with said gas pressure regulator for contacting said means through which pressurized gas is discharged to open said means to discharge pressurized gas;

sealing means associated with said means through which pressurized gas is discharged and said means for contacting for defining a second passageway for receiving discharged pressurized gas from said first passageway;

said means through which pressurized gas is discharged and said means for contacting cooperating so that pressurized gas is introduced into said first passageway substantially immediately after said second passageway is defined;

said sealing means retaining pressurized gas in said second passageway so that the forces exerted by said pressurized gas tending to separate said means through which pressurized gas is discharged from said means for contacting are balanced by forces from said pressurized gas tending to urge said means through which pressurized gas is released toward said means for contacting;

said sealing means cooperating with said means through which pressurized gas is discharged and said means for contacting to provide frictional forces sufficient to hold together said means through which pressurized gas is discharged with said means for contacting.

2. Apparatus as in claim 1 wherein:

said means through which pressurized gas is discharged and said means for contacting having relative configurations so that said second passageway is in fluid communication with said receiving means of said gas pressure regulator when said pressurized gas is introduced into said first passageway.

3. Apparatus as in claim 2 wherein:

said means through which pressurized gas is discharged comprises a male element having a check valve normally held in a closed position and located around a central longitudinally extending axis;

said gas pressure regulator receiving means being located around a central longitudinally extending axis forming an angle of about 90° with the central longitudinally extending axis of said male element;

said means for contacting comprises a female element having a configuration corresponding to said male element; and means in said female element located around a central longitudinally extending axis so as to contact said check valve and move it to an open position when said male element has been inserted into said female element.

4. Apparatus as in claim 3 and further comprising:

means for mounting said gas pressure regulator in a fixed location so that a source of compressed gas may be readily installed into an operative position and also readily removed when desired.

5. Apparatus as defined in claim 3 wherein:

said means providing said first passageway is supported by said means for contacting and said gas pressure regulator.

6. Apparatus as defined in claim 3 wherein:

said means for contacting and said gas pressure regulator are supported by said means providing said first passageway.

7. Apparatus as defined in claim 3 wherein said sealing means comprises:

a plurality of spaced grooves in said means providing said first passageway; and an O-ring gasket seated in each of said grooves.

8. Apparatus as defined in claim 3 wherein said sealing means comprises:

a plurality of spaced grooves in said means for contacting; and an O-ring gasket seated in each of said grooves.

9. Apparatus as defined in claim 3 and further comprising venting means for allowing the escape of air as said means providing said first passageway and said means for contacting are assembled.

10. Apparatus comprising a system wherein a gas pressure regulator is connected to a source of compressed gas under relatively high pressure to provide gas for an end use at a reduced pressure from that in said source comprising:

a source of compressed gas under relatively high pressure having means attached thereto through which pressurized gas is discharged;

means operatively associated with said means through which pressurized gas is discharged for providing a first passageway for pressurized gas discharged from said means through which pressurized gas is discharged;

a gas pressure regulator having means for receiving said pressurized gas and for discharging said pressurized gas at reduced pressures;

means associated with said gas pressure regulator for contacting said means through which pressurized gas is discharged to open said means to discharge pressurized gas;

sealing means associated with said means through which pressurized gas is discharged and said means for contacting for defining a second passageway for providing fluid communication between said means providing said first passageway and said receiving means of said gas pressure regulator;

said means through which pressurized gas is discharged and said means for contacting having dimensions so that pressurized gas is introduced into said first passageway and said second passageway is defined substantially simultaneously;

said sealing means retaining pressurized gas in said second passageway so that the forces exerted by said pressurized gas tending to separate said means through which pressurized gas is discharged from said means for contacting are balanced by forces from said pressurized gas tending to urge said means through which pressurized gas is released towards said means for contacting; and said sealing means cooperating with said means through which pressurized gas is discharged and said means for contacting to provide frictional forces sufficient to hold together said means through which pressurized gas is discharged with said means for contacting.

11. A method for transferring pressurized gas from a source of gas under relatively high pressure to a gas pressure regulator having means for receiving said pressurized gas and discharging said pressurized gas at a reduced pressure comprising:

providing a source of gas under relatively high pressure with means for discharging pressurized gas therefrom;

providing a gas pressure regulator with means for receiving said discharged pressurized gas and discharging said received pressurized gas at reduced pressures;

providing means in operative association with said discharge means of said source for providing a passageway for pressurized gas discharged from said discharge means of said source;

assembling said receiving means and said means providing said passageway and engaging said means providing said passageway and said receiving means with sealing means to form a fluid tight space between said means providing said passageway and said receiving means;

discharging pressurized gas from said source and passing said discharged pressurized gas through said means providing said passageway and said fluid tight space into said receiving means substantially immediately after said fluid tight space has been formed;

distributing the forces from said pressurized gas so that the forces from said pressurized gas tending to separate said means providing said passageway and said receiving means are balanced by the forces from said pressurized gas tending to urge said means providing said passageway and said receiving means together; and controlling the frictional forces of said sealing engagement between said means providing said passageway and said receiving means to hold said means providing said passageway and said receiving means together.

12. A method as in claim 1 and further comprising:

providing said source of gas under relatively high pressure in a container; and mounting said means for discharging said gas from said container and said means providing said passageway so that the weight of said container and said means providing said passageway are supported by said receiving means.

* * * * *

UNITED STATES PATENT AND TRADEMARK OFFICE

CERTIFICATE OF CORRECTION

PATENT NO. : 4,479,520

DATED : October 30, 1984

INVENTOR(S) : Clair D. Holben

It is certified that error appears in the above—identified patent and that said Letters Patent is hereby corrected as shown below:

In the Detailed Description of the Preferred Embodiments, Column 5, Line 38, "adjcent" should read --adjacent--. In the Claims, Column 10, Line 25, "comrising" should read --comprising--; Column 12, Claim 12, Line 60, delete "1" and insert --11--.

Signed and Sealed this

*Twenty-sixth* Day of *March 1985*

[SEAL]

*Attest:*

DONALD J. QUIGG

*Attesting Officer*

*Acting Commissioner of Patents and Trademarks*